US007648396B2

(12) United States Patent
Nickol et al.

(10) Patent No.: US 7,648,396 B2
(45) Date of Patent: Jan. 19, 2010

(54) PROTECTIVE HOUSING FOR ELECTRICAL CONNECTORS

(75) Inventors: Marcell Nickol, Creuzburg/Scherbda (DE); Norbert Carl, Riedstadt (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 149 days.

(21) Appl. No.: 12/080,838

(22) Filed: Apr. 7, 2008

(65) Prior Publication Data

US 2008/0254682 A1 Oct. 16, 2008

(30) Foreign Application Priority Data

Apr. 10, 2007 (DE) ..... 20 2007 005 264 U

(51) Int. Cl.
*H01R 9/03* (2006.01)

(52) U.S. Cl. ..... 439/607.54; 439/607.41

(58) Field of Classification Search ..... 439/607.01, 439/607.41, 607.5, 607.54
See application file for complete search history.

(56) References Cited

U.S. PATENT DOCUMENTS

| | | | | |
|---|---|---|---|---|
| 5,733,146 | A * | 3/1998 | Block | 439/607.54 |
| 6,612,868 | B2 * | 9/2003 | Hwang | 439/607.54 |
| 7,048,586 | B2 * | 5/2006 | Ishizaki et al. | 439/607.44 |
| 7,195,518 | B2 * | 3/2007 | Bert et al. | 439/607.43 |
| 7,255,602 | B1 * | 8/2007 | Driessen et al. | 439/607.47 |

* cited by examiner

*Primary Examiner*—Khiem Nguyen
(74) *Attorney, Agent, or Firm*—Lawrence E. Laubacher, Sr.; Lawrence E. Laubscher, Jr.

(57) ABSTRACT

A shielding device for an electrical connector for joining a contact with an electrical line or cable includes a cylindrical shield member formed of brass arranged within the connector. The shield member contains an opening in a central region which defines cylindrical sleeves at each end of the member and a transitional portion joining the cylindrical sleeves. One of the sleeves receives the contact and the other of the sleeves receives an end of the electrical line. The shield member transitional portion defines a fold line about which the cylindrical sleeves are bent toward each other at a desired obtuse angle. Portions of the cylindrical sleeves overlap when the sleeves are bent toward each other to at least partially close the opening and shield the connection between the contact and the electrical line.

10 Claims, 4 Drawing Sheets

PROTECTIVE HOUSING FOR ELECTRICAL CONNECTORS

BACKGROUND OF THE INVENTION

The present invention relates to a shield device for a plug type electrical connector attached to an electrical line or cable. The connector has at least one contact arranged on a contact carrier. The shield device includes cylindrical sleeves at each end, one for receiving the contact carrier and one for receiving the end of the electrical line.

It is often required to shield electrical lines such as high-frequency lines. Electrical connectors at the ends of such lines can be configured as a plug having at least one contact pin or as a socket having at least one contact socket. Where shielding of electrical lines is required, it is essential that the plug connectors also have sufficient shielding, not only for the cable or line, but especially for the transition area between the line and the plug connector. This is accomplished by the shield device of the present invention.

The electrical line is generally encased with an outer protective braid and has an exposed conductor portion at the end of the line. The connection between the electrical connector and the electrical line occurs by deforming or crimping the shield device about the electrical line.

BRIEF DESCRIPTION OF THE PRIOR ART

The shield devices known in the art are typically formed from several individual pieces of different configurations in order to accommodate different angular positions of the shield devices. Thus, conventional shield devices are relatively costly.

The present invention was developed in order to overcome these drawbacks by providing a shield device that can be produced economically in the form of two sleeves for the contact carrier and electrical line, respectively, which can be moved continuously from a position where the sleeves are aligned with each other to a position where the sleeves are perpendicular to each other.

SUMMARY OF THE INVENTION

In accordance with the invention, the shielding device is formed as a single cylindrical shield member, and the transitional region between the two cylindrical sleeves is provided with an opening or cutout in a central region thereof so that a fold line is formed in a transition portion of the member which joins the cylindrical sleeves. Accordingly, the two sleeves can be folded about the fold line to angled positions relative to each other.

Owing to the unitary design of the shield device, it is not necessary to assemble several individual shielding pieces to form a shield device which encapsulates the end of the electrical line within an electrical connector. The cutout for producing the fold line can be produced by suitable fabrication methods without deforming the cylindrical sleeves at the ends of the shield device on either side of the transition portion. Another benefit is that the cylindrical sleeves of the shield device can be moved into the desired angled positions without having to modify to the connector. These angled positions in a preferred embodiment lie between 90 and 180 degrees.

It is especially advantageous that the two cylindrical sleeves can be moved continuously from a first position where the axes of the sleeves are in alignment to a second position wherein the sleeve axes are arranged at 90 degrees relative to each other. Accordingly, the same unitary cylindrical shield member can be used for different configurations of connectors.

The opening defined by removing a portion of the wall of the cylindrical shield member is preferably tapered in the direction of the transition portion. More particularly, the opening is widest when measured across the surface of the cylindrical shield member along a line parallel to the axis of the member. Proceeding circumferentially around the shield member, the width of the opening diminishes. The residual portion of the shield member comprises the transition portion. It contains a fold line about which the cylindrical sleeves at the opposite ends of the shield member can be bent toward each other so that the sleeves move from an aligned position with their axes co-linear to a normal position with their axes arranged at 90 degrees.

According to a preferred embodiment, the portion removed from the cylindrical shield member to define the opening is configured so that the edges of the residual cylindrical sleeve wall portions adjacent to the opening having a stepped configuration. As the sleeves are bent toward each other through an obtuse angle, the edge portions of the sleeves overlap to define a contact region. The further the sleeves are bent, the greater the overlap.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
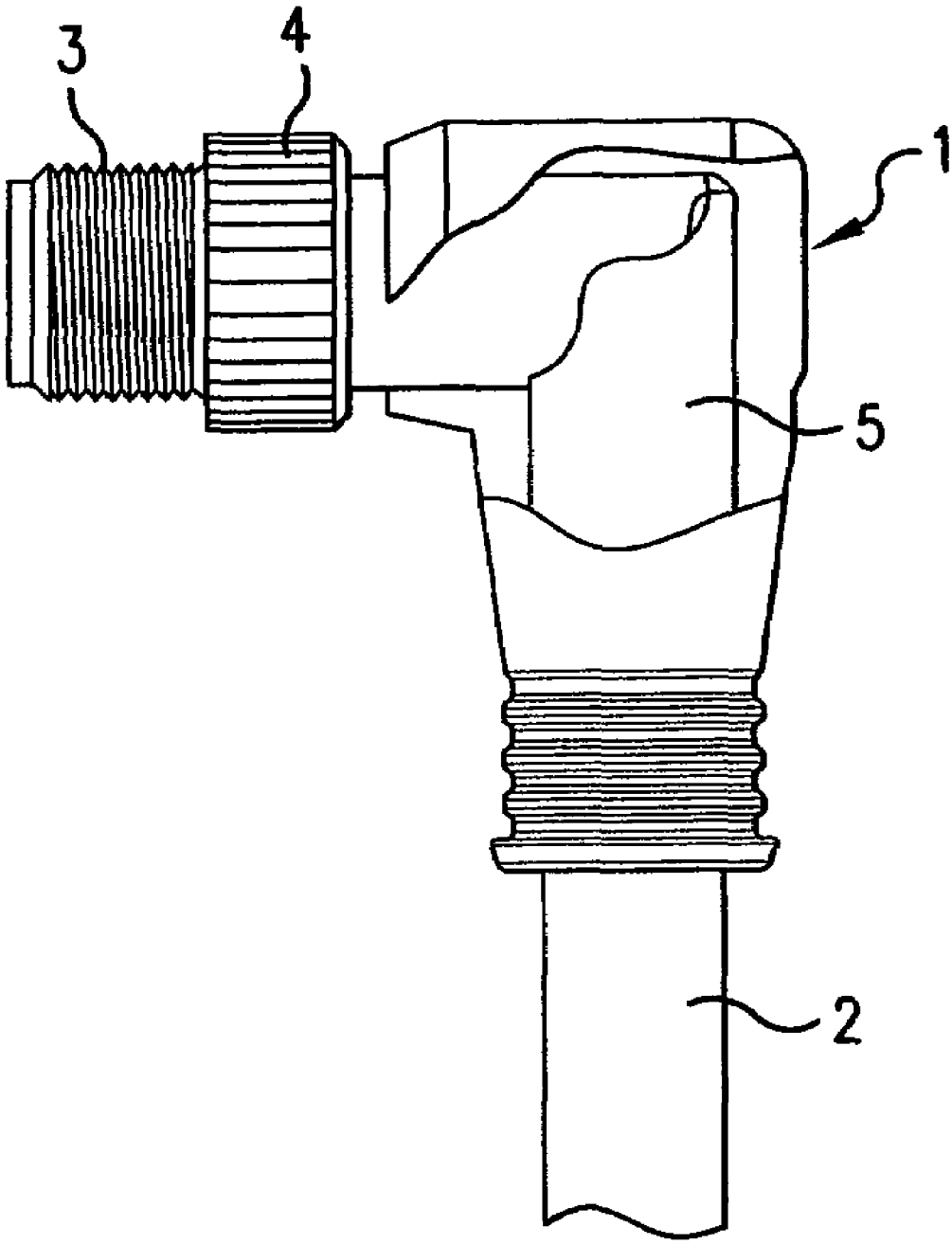
FIG. 1 is a partial cutaway plan view of a plug connector containing a shield device according to the invention.

Referring first to FIG. 1, there is shown a plug-type electrical connector 1 including at least one contact pin or at least one contact socket. These contacts are mounted on a contact carrier in a conventional manner (not shown) which is connected with an electrical line 2. For reliable connection of the plug connector 1 with a separate element, the connector includes a threaded fitting 3 and a nut 4 at the end spaced from the electrical line 2. The fitting and nut cooperate to provide a secure connection. The plug connector 1 further includes a shielding device 5 which encapsulates the electrical line 2 and which is arranged inside a handle.

Figure 2:
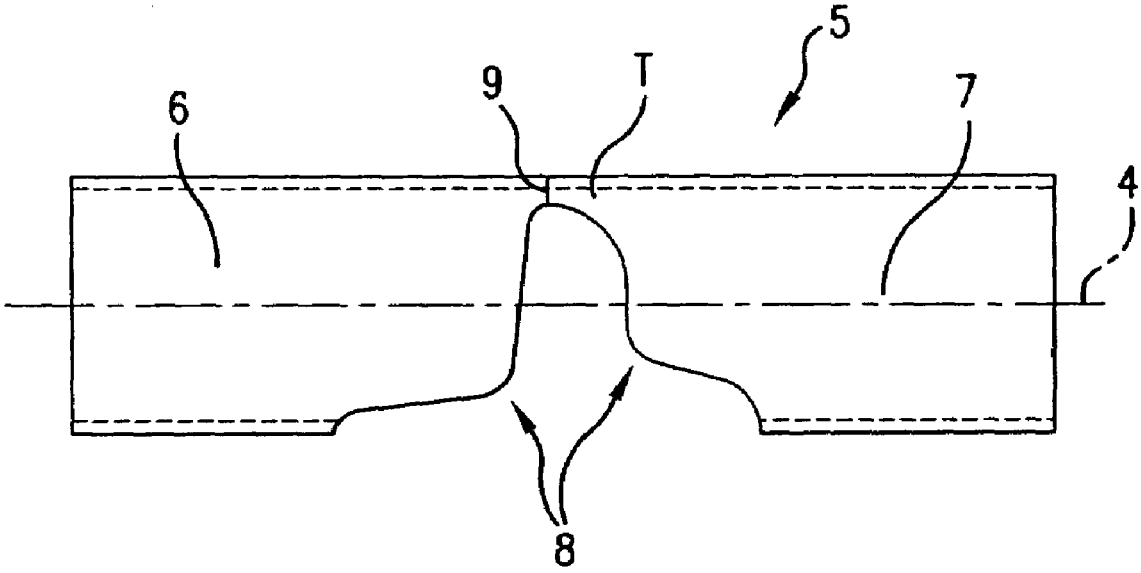
FIG. 2 is a plan view of the shield device with the cylindrical sleeves thereof in their initial aligned position.
Figure 3:
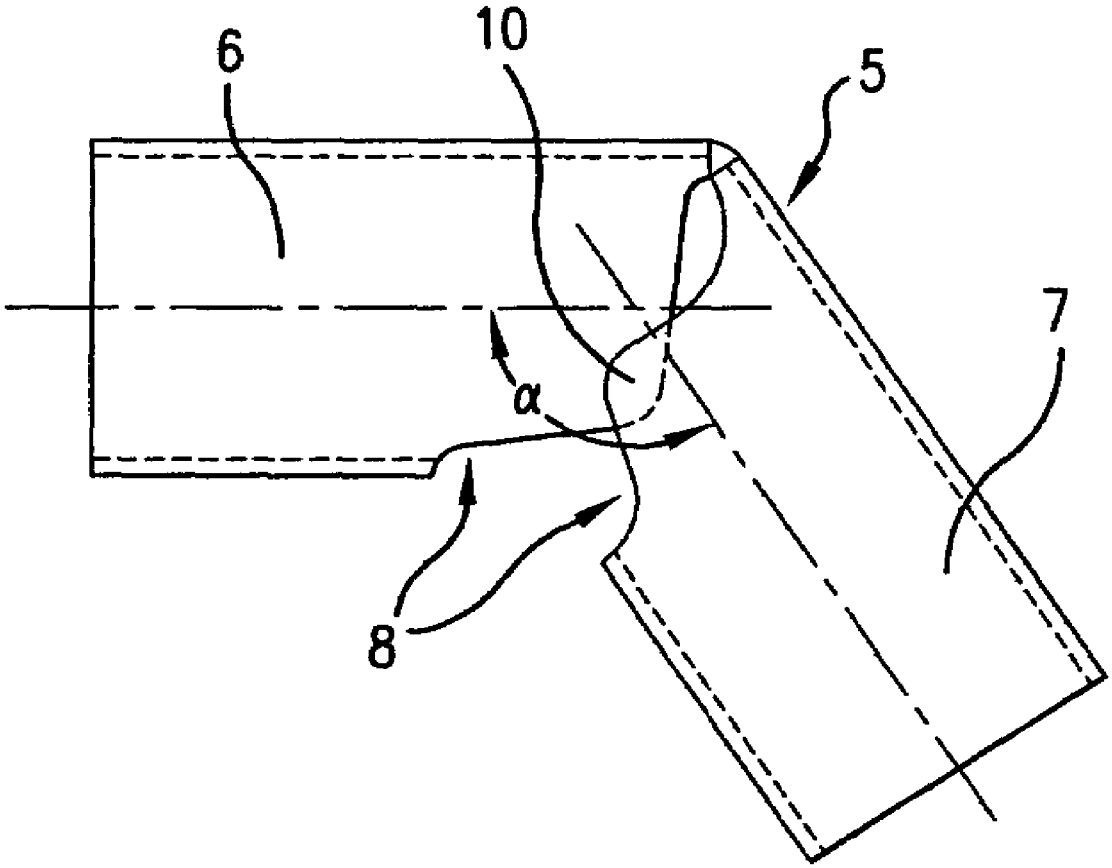
FIG. 3 is a plan view of the shield device of FIG. 2 in a position where the two cylindrical sleeves are folded at an obtuse angle relative to each other.
Figure 4:
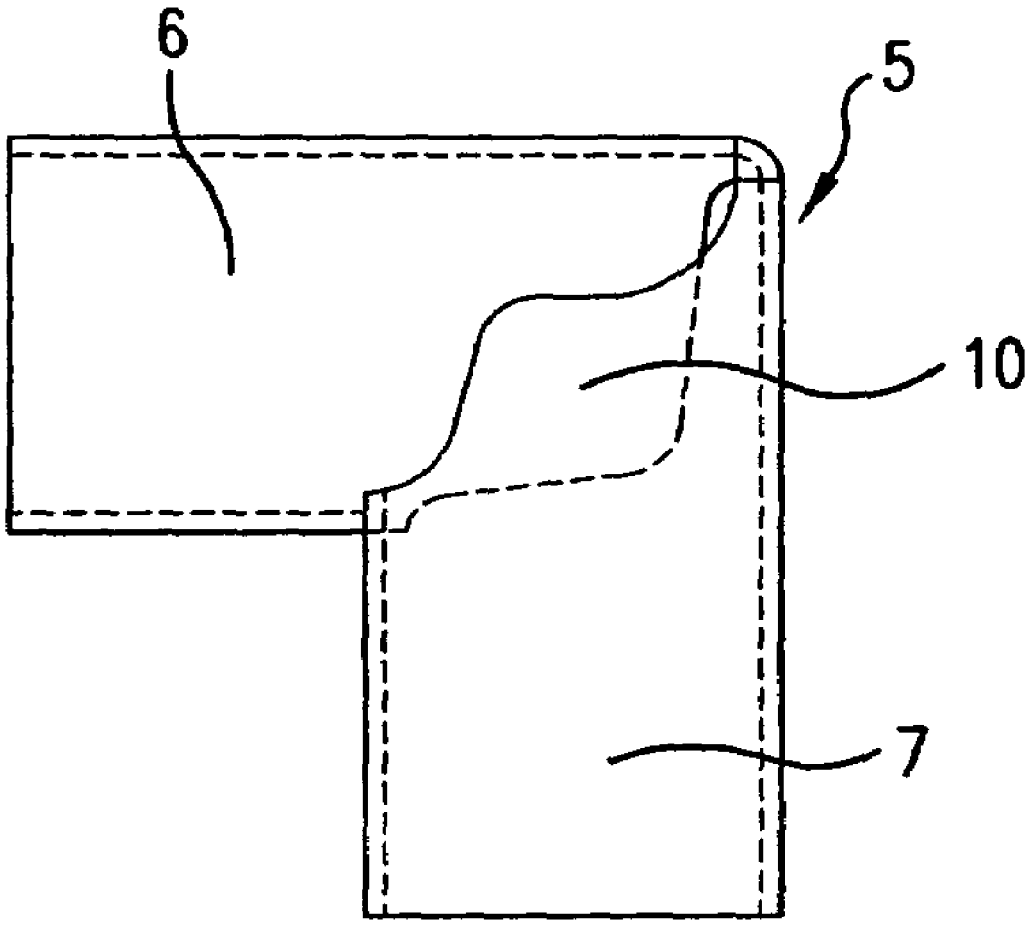
FIG. 4 is a plan view of the shield device in a position where the two cylindrical sleeves are arranged at a right angle relative to each other.

The shielding device 5 will be described in greater detail in connection with FIGS. 2-4. The shielding device is in the form of a cylindrical member having a longitudinal axis A as shown in FIG. 2. The cylindrical member 5 is divided into two cylindrical sleeves 6, 7 as the result of removing a portion of the wall of the cylindrical member in a central region thereof to define a cutout region or opening 8. One of the sleeves is adapted to receive a contact and the other of the sleeves receives the exposed end of the electrical line or cable, with the sleeve being connected with the line by crimping or any other conventional connection. The residual or transitional portion T of the cylindrical member joins the two sleeves 6, 7 and contains a fold line 9 about which the cylindrical sleeves are bent in order to arrange the sleeves into an angled position as shown in FIGS. 3 and 4. In a preferred embodiment, the shielding device 5 is formed of brass using a deep drawing process and includes an outer coating of nickel.

Referring to FIG. 2, the cutout 8 is tapered in the direction toward the transitional portion T of the shielding device 5. The edges of the cylindrical sleeves 6, 7 bordering the cutout 8 are arranged at an angle and preferably have a stepped configuration as shown in FIG. 2. The edge surfaces between the steps have a radial curvature. Moreover, the transitional portion T containing the fold line 9 is arcuate owing to the curvature of the cylindrical wall with the midpoint of the curvature defining the fold line 9. The two regions associated with the fold line 9 furthermore extend generally parallel to each other. The width of the opening in the region of the shielding device remote from the transitional portion T is greater than the width of the opening adjacent to the transitional portion. In the embodiment shown in FIG. 2, the width at the remote region is approximately four times greater than the width of the opening adjacent to the transitional portion.

FIG. 3 shows the shielding device 5 in which the axes of the two cylindrical sleeves 6, 7 are arranged at an obtuse angle $\alpha$ relative to each other. In the embodiment shown, the angle is approximately 135 degrees. In this position, the radial stepped portion of the edge of the cylindrical sleeve 7 at the electrical line end of the shielding device overlaps the radial stepped portion of the edge of the cylindrical sleeve 6 at the contact end of the shielding device to produce a contact surface 10 which encapsulates the end of the electrical line and shield the connection from outside interference. As the two cylindrical sleeves are bent to a perpendicular arrangement where the axes of the sleeves are arranged at 90 degrees as shown in FIG. 4, the overlapping area of the sleeves increases to enlarge the contact surface.

It will be readily apparent that the angle $\alpha$ between the axes of the cylindrical sleeves 6, 7 can be selected continuously between 180 and 90 degrees as shown in FIGS. 2 and 4, respectively, in accordance with the configuration of the connector in which the shield device is installed.

While the preferred embodiment of the invention has been illustrated and described, it will be apparent to those of ordinary skill in the art that various changes and modifications may be made without deviating from the inventive concepts set forth above.

What is claimed is:

1. A shielding device for an electrical connector for joining a contact with an electrical line, comprising a cylindrical shield member arranged within the connector and containing an opening in a central region thereof to define cylindrical sleeves at each end of said shield member and a transitional portion joining said cylindrical sleeves, one of said sleeves receiving the contact and the other of said sleeves receiving an end of the electrical line, said shield member transitional portion defining a fold line affording movement of said cylindrical sleeves toward each other at a desired angle, whereby contact portions of said sleeves overlap to at least partially close the opening and shield the connection between the contact and the electrical line.

2. A shielding device as defined in claim 1, wherein said shield member is folded about said fold line to a desired position between a first position wherein the axes of said cylindrical sleeves are colinear and a second position wherein said the axes of said cylindrical sleeves are arranged at 90 degrees.

3. A shielding device as defined in claim 1, wherein said opening tapers toward said transitional portion.

4. A shielding device as defined in claim 3, wherein the edges of said cylindrical sleeves defined by said opening are opposed and arranged at an obtuse angle.

5. A shielding device as defined in claim 4, wherein said transitional portion of said cylindrical shield member has an arcuate configuration.

6. A shielding device as defined in claim 5, wherein said fold line is defined at the midpoint of said arcuate transitional portion.

7. A shielding device as defined in claim 3, wherein said opening has a stepped configuration, thereby defining a contact region of overlapping portions of said cylindrical sleeves when said sleeves are folded toward each other.

8. A shielding device as defined in claim 7, wherein the width of said opening in said cylindrical shield member is greater at an area remote from said transitional portion.

9. A shielding device as defined in claim 8, wherein the width of said opening at said remote area is generally four times greater than the width of said opening adjacent to said transitional area.

10. A shielding device as defined in claim 1, wherein said shield member is formed of brass with a nickel coating.

* * * * *